US007458138B2

(12) United States Patent
Spiers et al.

(10) Patent No.: US 7,458,138 B2
(45) Date of Patent: Dec. 2, 2008

(54) GRAVE LINING SYSTEM

(75) Inventors: David Spiers, County Down (IE); Michael Evason, County Tyrone (IE)

(73) Assignee: David Spiers, County Down (IE)

( * ) Notice: Subject to any disclaimer, the term of this patent is extended or adjusted under 35 U.S.C. 154(b) by 23 days.

(21) Appl. No.: 11/591,964

(22) Filed: Nov. 2, 2006

(65) Prior Publication Data

US 2007/0113389 A1 May 24, 2007

(30) Foreign Application Priority Data

Nov. 2, 2005 (GB) ..... 0522325.0

(51) Int. Cl.
*E02D 19/00* (2006.01)

(52) U.S. Cl. ..... 27/29; 52/136

(58) Field of Classification Search ..... 27/29, 27/35; 52/128, 136–137, 103
See application file for complete search history.

(56) References Cited

U.S. PATENT DOCUMENTS

| | | | | | |
|---|---|---|---|---|---|
| 834,204 | A * | 10/1906 | Hodges | 52/137 |
| 908,305 | A * | 12/1908 | Moore | 52/137 |
| 951,493 | A * | 3/1910 | Renshaw | 52/137 |
| 1,030,385 | A * | 6/1912 | Clarkson | 52/137 |
| 1,204,686 | A * | 11/1916 | Raydure | 52/136 |
| 1,964,234 | A * | 6/1934 | Vogel | 52/141 |
| 2,822,685 | A * | 2/1958 | Chandler et al. | 52/137 |
| 3,230,674 | A * | 1/1966 | Christensen | 52/127.1 |
| 3,596,419 | A * | 8/1971 | Jalbert | 52/137 |
| 3,772,826 | A * | 11/1973 | Ferver | 47/66.6 |
| 3,898,718 | A * | 8/1975 | Eubank | 27/35 |
| 3,958,378 | A * | 5/1976 | Omeechevarria | 52/136 |
| 5,511,345 | A * | 4/1996 | Jones et al. | 52/136 |
| 5,590,446 | A * | 1/1997 | Hicks | 27/1 |
| 5,746,030 | A * | 5/1998 | Sannipoli, Sr. | 52/136 |
| 5,960,524 | A * | 10/1999 | Darby et al. | 27/35 |
| 6,243,997 | B1 * | 6/2001 | Sannipoli | 52/128 |
| 2005/0278911 | A1 * | 12/2005 | McKenna | 27/29 |

FOREIGN PATENT DOCUMENTS

| | | |
|---|---|---|
| DE | 203 08 407 U1 | 10/2003 |
| EP | 1 783 303 A1 | 5/2007 |
| FR | 2 449 767 | 9/1980 |
| FR | 2 694 777 A1 | 2/1994 |
| FR | 2 755 716 A1 | 5/1998 |
| FR | 2 836 693 A1 | 9/2003 |
| WO | WO 01/62200 A1 | 8/2001 |

* cited by examiner

*Primary Examiner*—William L. Miller
(74) *Attorney, Agent, or Firm*—Whiteford, Taylor & Preston, L.L.P

(57) ABSTRACT

The present invention provides a grave lining system comprising a casing which defines an enclosure which may be divided into a number of vertically stacked modules or compartments, each capable of receiving an individual coffin therein, the system further comprising a lid which allows repeated access to the enclosure defined by the casing, without requiring the disturbance of any flowerbed or the like provided above the lid.

15 Claims, 8 Drawing Sheets

GRAVE LINING SYSTEM

CROSS REFERENCE TO RELATED APPLICATION

This application is based upon and claims the benefit of United Kingdom Patent Application No. 0522325.0, filed on Nov. 2, 2005, by the inventors herein, the specification of which is incorporated herein by reference.

FIELD OF THE INVENTION

The present invention relates to a grave lining system, and in particular, to a grave lining system that allows a plurality of coffins to be located in a single grave.

BACKGROUND TO THE INVENTION

Land suitable as burial ground is becoming increasingly hard to find. There is therefore a need to explore space saving alternatives.

In circumstances where many bodies need to be buried in mass graves, the burial may need to be quick and simple yet still provide a decent burial site for multiple coffins.

Similarly, it may be desired to bury additional family members at the site of an existing grave, but there may be no space adjacent said grave at which to dig further graves.

It would be desirable to provide a system that mitigates the problems identified above.

SUMMARY OF THE INVENTION

The present invention provides a grave lining system comprising a sidewall defining an enclosure; at least one divider; and retaining means in operative association with the sidewall for supporting the at least one divider in a position dividing the enclosure into substantially separate compartments.

Preferably, the enclosure comprises a plurality of stackable modules which in combination define the sidewall.

Preferably, a divider is provided for each module.

Preferably, the system comprises a lid engageable about an opening defined by the sidewall in order, in use, to substantially seal the opening.

Preferably, the lid comprises a tray.

Preferably, the lid comprises means for securing a headstone to the lid.

Preferably, the sidewall comprises a plurality of protrusions formed therein.

Preferably, the retaining means comprises sets of tongues and grooves, the tongues being provided on the at least one divider and the grooves being provided on the sidewall.

Preferably, the system comprises connecting means provided about the sidewall externally of the enclosure.

Preferably, the system comprises an outer wall locatable about at least a portion of the sidewall.

Preferably, the outer wall is connectable to the connecting means.

Preferably, the system comprises connecting means provided about the sidewall externally of the enclosure, an outer wall locatable about at least a portion of the sidewall, and wherein the outer wall is connectable to the connecting means.

Preferably, at least a portion of the sidewall is hollow and capable of receiving ballast therein.

Preferably, at least a portion of the outer wall is hollow and capable of receiving ballast therein.

Preferably, the at least one divider comprises a drain.

Preferably, the connecting means are adapted to enable two or more of the grave lining systems to be connected to one another.

Preferably, the lid comprises a pedestrian platform.

Preferably, the system comprises a drain chamber located, in use, at the bottom of the casing. Alternatively, the drain chamber may be open to the soil below.

Additional grave lining systems may be placed in an adjacent manner and secured relative to one another, preferably using the connecting means. More preferably the connecting means may permit, in use, vertical sliding so that an adjacent grave lining system may have a different vertical position.

According to a further aspect of the present invention, there is provided a lid for a grave comprising a tray; and means for securing a headstone to the lid.

Preferably, the lid comprises a collar locatable, in use, within and about a mouth of a grave.

Preferably, the securing means are positioned within the tray.

Preferably, the lid comprises a drain hole extending from the tray to an exterior of the lid.

Preferably, the lid comprises locking means adapted to releasably lock a headstone to the lid.

The advantages of the present invention are that multiple coffins and urns can be located within one grave. This may be used for example in a family plot or larger mass grave. This form of burial is space saving and in the case of a mass burial provides a quick and easy, yet decent burial method.

As used herein, the term "sidewall" is intended to mean a wall or boundary, which when in situ is in the form of a substantially closed loop or circuit such as to define an enclosure therein, and which may or may not have breaks along the length thereof.

As used herein, the term "enclosure" is intended to mean a space bounded by a wall or other boundary, and which may or may not be open at one or other end.

As used herein the term "tray" is intended to mean an element or arrangement of elements which define a depression or cavity into which material or components may be located, for example soil, gravel or the like, in particular for the purposes of creating a flower bed or the like.

As used herein the term "pedestrian" is intended to mean of, relating to, or designed for walking or standing on.

Further advantageous aspects of the invention will become apparent to those ordinarily skilled in the art upon review of the following description of a specific embodiment and with reference to the accompanying drawings.

BRIEF DESCRIPTION OF THE DRAWINGS

Embodiments of the invention will now be described by way of example and with reference to the accompanying drawings in which.

DESCRIPTION OF THE PREFERRED EMBODIMENTS OF THE INVENTION

Figure 1:
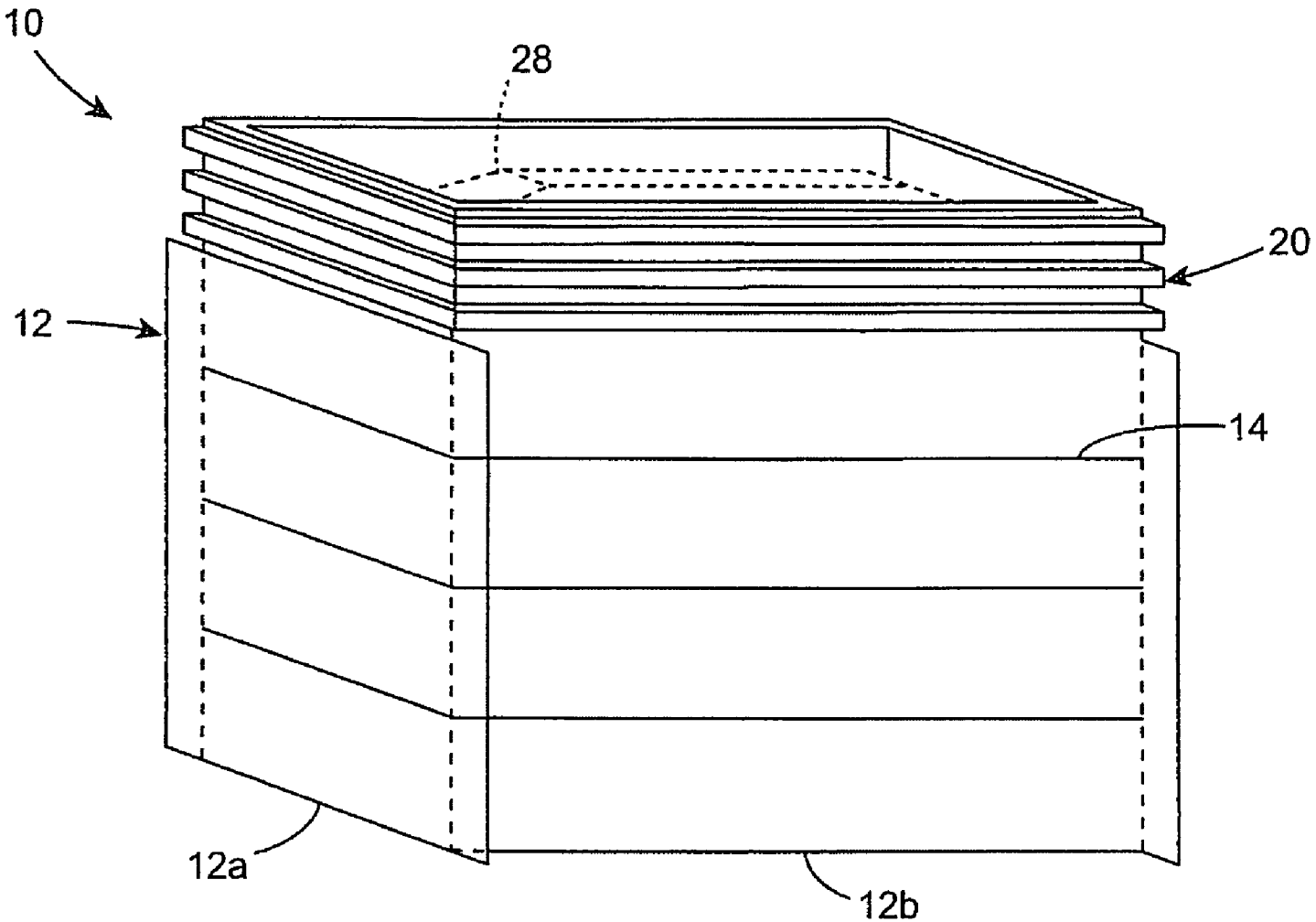
FIG. 1 shows a perspective view of a grave lining system according to one embodiment of the invention.
Figure 2:
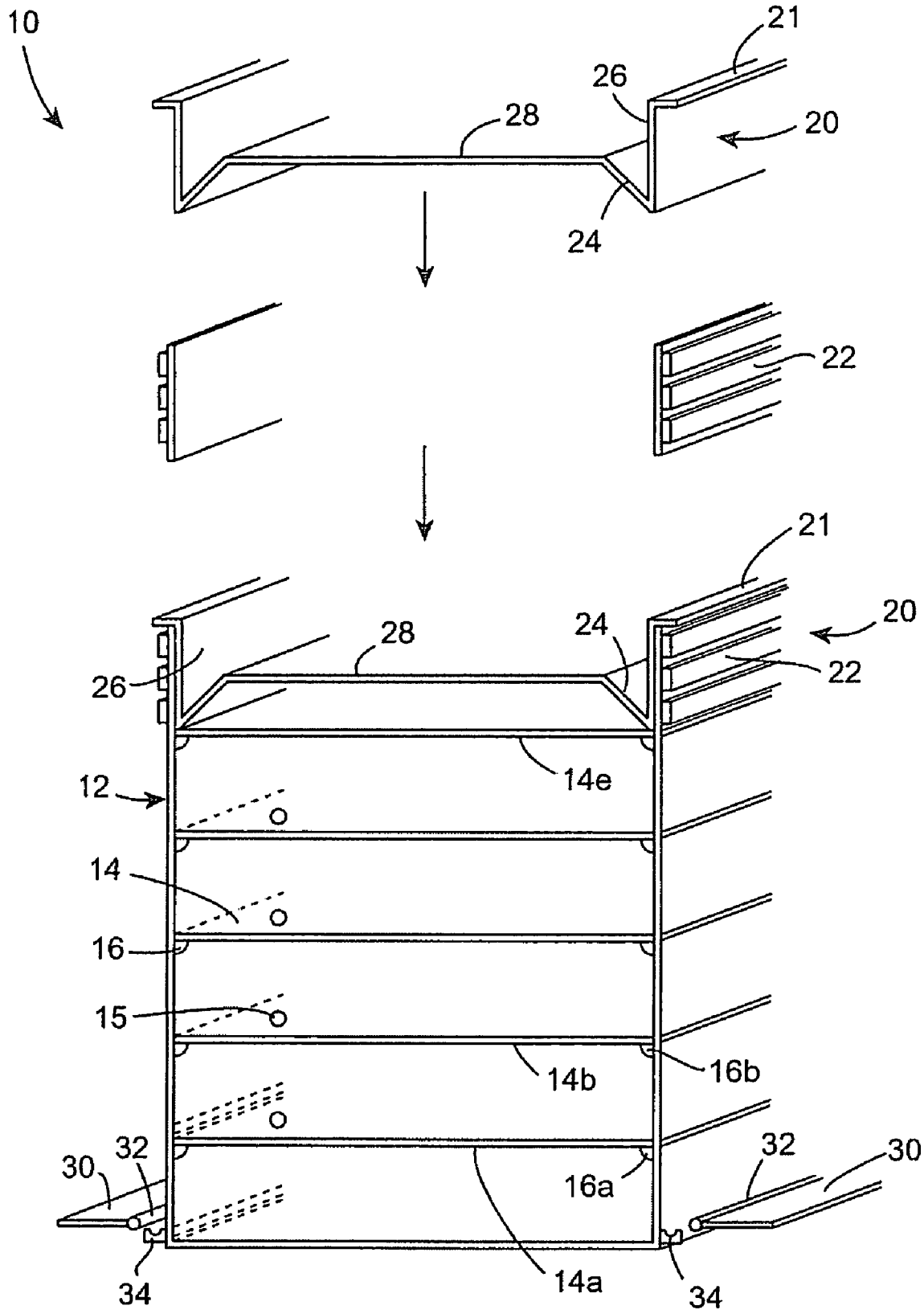
FIG. 2 shows a longitudinal cross-section of the grave lining system of FIG. 1.
Figure 3:
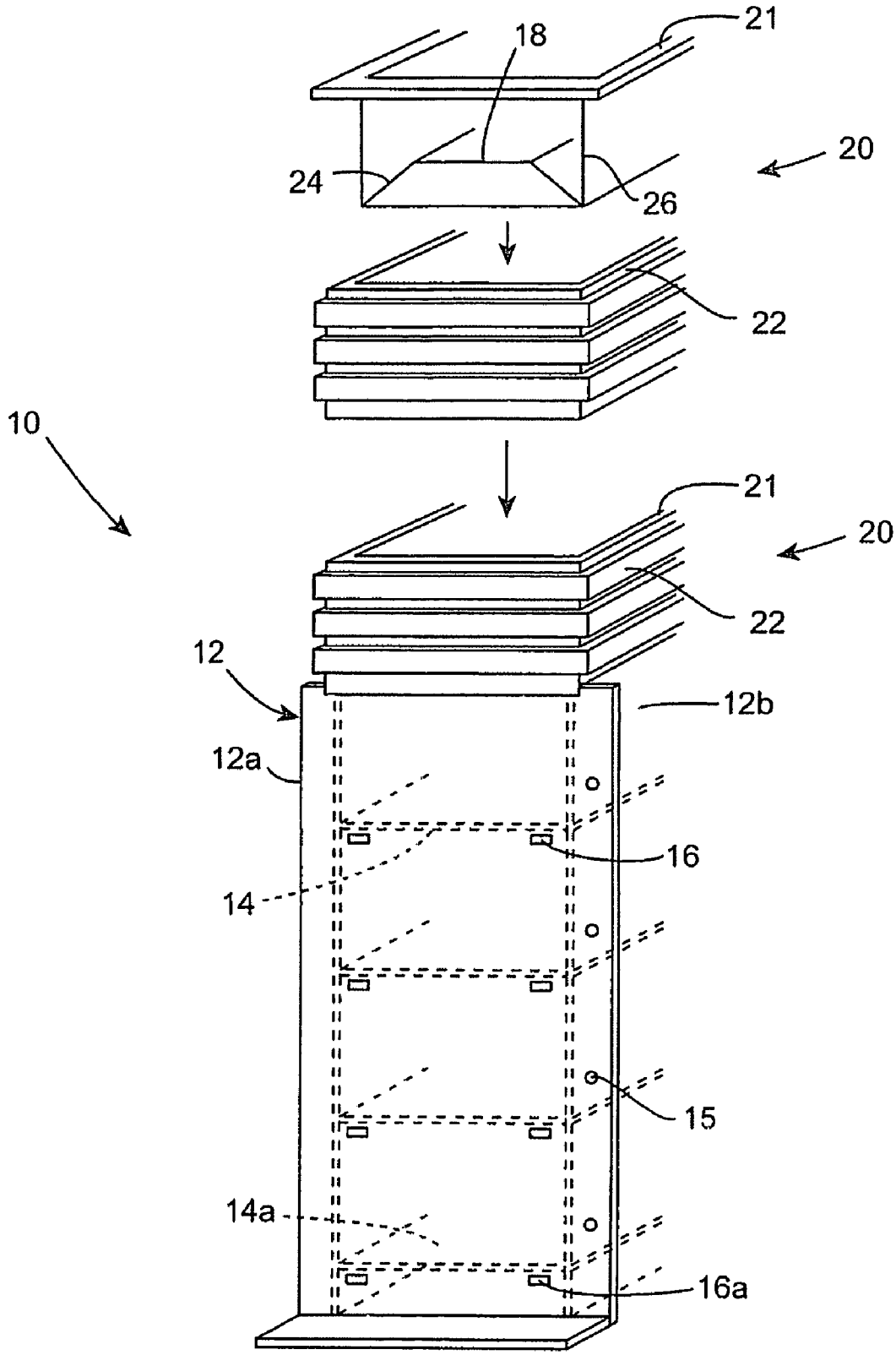
FIG. 3 shows a side view of the grave lining system of FIG. 1.

Referring now to FIGS. 1 to 3 of the drawings there is shown, generally indicated as 10, a grave lining system according to a first embodiment of the invention. The grave lining system 10 comprises a sidewall in the form of a casing 12, which is preferably substantially rectangular in plan, and which is made up of side sections 12*a* and 12*b*, slotted together, and interlocked to form the casing 12. The casing 12 is rectangular in plan in order to efficiently accommodate a coffin or casket (not shown) therein. It will therefore be appreciated that the casing 12 need not be limited to a rectangular shape, and that any other suitable alternative could be employed. The casing 12 is preferably formed from a water resistant material, and more preferably a water impermeable material such as a polymer or metal or the like.

Each side section 12*a*, 12*b* may be formed as a single panel, or may be formed from a number of smaller panels secured together in any suitable manner. The casing 12 can be divided into separate, in use, horizontal modules or compartments of substantially equal size by the addition of dividers in the form of shelves 14. The shelves 14 are positioned by retaining means in the form of abutments or supporting ledges 16, shown in FIG. 2, on the inside of the casing 12.

During use, the casing 12 lines a grave and the bottom most shelf 14*a* is positioned on the lowest set of ledges 16*a*. A coffin or casket (not shown) can be placed and supported on this bottom shelf 14*a* and the second most bottom shelf 14*b* subsequently positioned on the corresponding ledges 16*b* to substantially seal the compartment. The remainder of the shelves 14 may be stored above the lowermost compartment until needed.

The grave lining system 10 also comprises a top section or lid generally indicated as 20. As shown in FIG. 2 the lid 20 is preferably tray shaped so that the edge 21 is located at or adjacent ground level but the top surface sits below ground (not shown). This allows, for example soil or stones to sit within the lid 20 and cover the grave, in order to provide a conventional appearance from above ground. As shown in FIGS. 2 and 3 the lid 20 rests within a collar 22, which is positioned on top of the casing 12, and within a mouth of the grave. To add another coffin to the grave lining system 10 the lid 20 can be removed from the collar 22 allowing access to the interior of the casing 12, while the collar 22 reduces the risk of soil etc falling into the casing 12. The unused shelves 14 stored within the casing 12 can also be removed and a coffin placed onto the lowest pre-positioned shelf 14 (the ceiling shelf 14 of the used compartment). Another shelf 14 is placed onto the corresponding ledges 16 to substantially seal this further compartment. Again, the unused shelves 14 can be stored in the remainder of the casing 12 and the lid 20 replaced. As a result, the outward appearance of the grave remains the same, as the soil etc in the lid 20 is undisturbed.

It is also envisaged that, in the event that each of the compartments defined within the system 10 were full, one or more additional modules or compartments (not shown) could be connected to the top or bottom of the casing 12, to provide increased capacity.

The lid 20 is shaped to also provide a chamber in the underside for storing, for example urns, using the top most shelf 14*e* as the base, as shown in FIG. 2. These urns and top shelf 14*e* can be removed to add additional coffins as previously described. Thus the lid 20 comprises a base 24 and a peripheral upstanding rim 26, from which rim 26 the edge 21 projects. The base 24 incorporates a raised portion 28 which thus defines a cavity 30 which, in use, can house one or more urns (not shown). It will be appreciated that the lid 20 could be used with a conventional grave in the absence of the casing 12, in order to provide a location for depositing urns. The rim 21 is preferably provided with lifting eyes (not shown) or the like, in order to allow the lid 20 to be removed when required. Although not illustrated, it is preferable that the lid 20 is provided with one or more drainage holes (not shown), preferably located at the bottom of the tray or trough defined between the base 24 and upstanding rim 26. Such an arrangement will then allow any water which would otherwise gather to drain from the lid 20. However, as the collar 22 has a close fit with the lid 20, the collar is preferably provided with a correspondingly positioned channel or groove (not shown) on the inward facing surface thereof in order to allow the water draining from the lid 20 to escape past the collar 22, and down the outside of the casing 12.

As shown in FIGS. 2 and 3, the bottom most shelf 14*a* may be positioned to produce, as shown, a smaller bottom compartment. This compartment may be used as a drain chamber to collect and allow liquid to be expelled. In another form of the invention, the drain chamber may be open to soil below.

To allow liquid to drain into the drain chamber each shelf 14 may have a drain in the form of an aperture or drain hole 15. The aperture may incorporate a non-returnable valve. This will allow, for example, any ground water or the like which finds its way into the interior of the casing 12, to drain downwardly through each shelf 14, and to exit the bottom of the casing 12.

Mounted to the exterior of the casing 12, adjacent the base thereof, are a pair of flaps or anchors 30 which are hingedly mounted to the respective panel 12*b* via a pair of apertures 32 (only one shown in each anchor 30), and a corresponding pair of hooks 34 (only one shown on each panel 12*b*). These anchors 30 are located in a substantially horizontal position, as illustrated in FIG. 2, during installation of the system 10, and thus when grave is backfilled, the pair of anchors 30 will be buried and thus will resist any vertical displacement of the system 10, thereby ensuring the long term stability thereof.

In the event of a mass burial, additional grave lining system 10 may be placed in an adjacent manner by connecting means (not shown) on the side section 12*b*. This connecting means may permit, in use, vertical sliding so the adjacent grave lining system 10 may have a different vertical position.

When not in use the components of the grave lining system can be stored as a flat pack.

Referring now to FIGS. 4 to 8 of the accompanying drawings, there is illustrated a second embodiment of a grave lining system according to the present invention, generally indicated as 110. In this second embodiment, like components have been accorded like reference numerals, and unless otherwise stated, perform a like functions. The system 110 comprises a side wall forming a substantially closed loop or circuit such as to create a casing 112 defining an enclosure internally thereof for receiving one or more coffins or caskets C. The system 110 further comprises at least one, and preferably a plurality of, dividers 114, which are locatable at spaced intervals within the enclosure defined by the casing 12, in order to define a number of individual compartments within each of which a coffin or casket may be located. The casing 112, when located in situ, is preferably water resistant, and more preferably substantially waterproof, in order to preserve any caskets C contained therein.

The casing 112 is preferably comprised of a plurality of, and in the embodiment illustrated, five modules 40 which are stacked one on top of the other to create the casing 112. In use, the number of modules 40 may be varied to suit individual requirements, for example the depth of the grave into which the system 110 is to be located, or the number of coffins to be stored within the system 110. Each module 40 is therefore preferably shaped and dimensioned to define an internal volume which is capable of containing a single coffin therein, as can be seen from FIG. 4. Thus in use each module 40 is preferably provided with a respective divider 114 in order to separate adjacent modules 40 from one another. The lowermost divider 114 of the system 110 acts as a base for the system 110, onto which the lowermost coffin C is positioned and supported. The next divider 114 then substantially seals in the lowermost coffin C, and acts as a platform onto which a subsequent coffin can be positioned. This process can then be repeated until each of the modules 40 has been filled with a respective coffin. In the embodiment illustrated, the system 110 is thus capable of storing four or five coffins, as will be described hereinafter in detail. The position or height at which each divider 114 is located may be varied, as will be described hereinafter.

Adjacent modules 40 are preferably inter-locked with one another. Thus each module 40 is preferably provided with inter-locking means in the form of a plurality of tabs 42 projecting upwardly from one rim of the module 40, and correspondingly positioned and dimensioned sockets 44 located about an opposite rim of the module 40. Said inter-locking means may of course take any other suitable form. The inter-locking means therefore allow adjacent modules 40 to be quickly and accurately stacked. Optionally, a gasket or similar seal (not shown) may be provided between adjacent pairs of modules 40 in order to provide a fluid tight seal therebetween. This will therefore reduce or prevent, in use, the migration of ground water to the interior of the casing 112.

Each module 40 is also preferably comprised of a number of individual panels, in particular a pair of side panels 46 and a pair of end panels 48, adjacent panels 46, 48 inter-locking with one another. In this way, for transport and/or storage or the like, each module 40 may be disassembled into the individual panels 46, 48 which can then be flat packed. It will be appreciated that each module 40 may be divided into more or less panels 46, 48.

The modules 40 are preferably formed from a water resistant material, and more preferably a waterproof material, for example a polymer or the like. The modules 40 may however be formed from any other material, for example a biodegradable material, although this is less desirable. Furthermore, at least a portion of each of the modules 40, and preferably each of the panels 46, 48, are substantially hollow in form, and may be filled, in use, with ballast such as water, sand or other suitable material. In this way, the modules 40 can be manufactured as lightweight and robust elements, which once ready for installation within a grave, or having actually been installed within a grave, can be filled with ballast in order to provide strength and stability thereto.

As a further preferred feature, the modules 40 are preferably provided with a plurality of protrusions 50 in an outer surface thereof. The protrusions act to stiffen the panels 46, 48 of the module 40, which is particularly advantageous when the modules are hollow in form. In addition, when the casing 112 is initially positioned within a freshly dug grave, there will exist a gap located between the outside of the casing 112 and the grave itself. This gap will then be back filled with soil. During this back filling, the soil will migrate between the protrusions 50 of the modules 40, and on compaction will provide a solid and robust anchoring of the system 110 in the surrounding earth.

Figure 6:
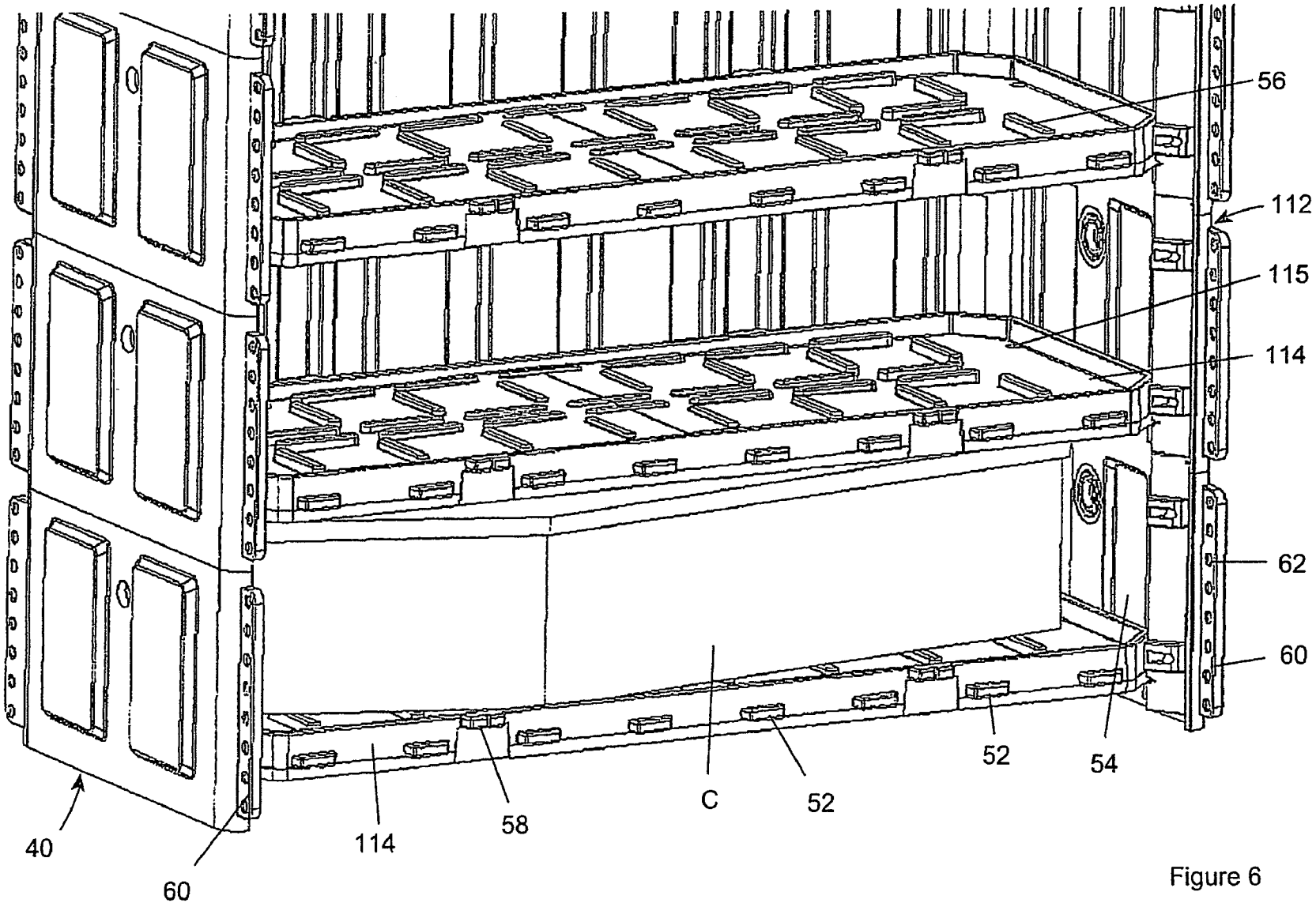
FIG. 6 shows an enlarged view of a portion of the system illustrated in FIG. 4.

Referring now in particular to FIG. 6, it can be seen that the system 110 comprises retaining means to secure each divider 114 in position, the retaining means comprising sets of tongues 52 and grooves 54, the tongues 52 being provided about a perimeter of each divider 114, while the grooves 54 are provided formed integrally with the casing 112, and in particular with each module 40. The dividers 114, as with the modules 40, are preferably moulded from a polymer, although any other suitable material may be used. Each divider 114 is, in the embodiment illustrated, provided with an array of stiffening ribs 56 formed integrally therewith, which allow the divider 114 to be relatively thin and lightweight while still embodying sufficient strength and rigidity for its intended purpose.

As with the first embodiment, each of the dividers 114 is provided with a drain 115 therein, in order to allow any ground water which has found its way into the interior of the casing 112 to drain downwardly through each of the modules 40, and thereafter escape through the open lower end of the casing 112. The ribs 56 are also optionally arranged in a pattern which defines an array of essentially rectangular spaces into each of which may be securely positioned an urn U (shown only in FIGS. 4 and 7) or the like, as will be described hereinafter. It will be understood that the ribs 56 may therefore be arranged in any other desired pattern or orientation. Each divider 114 also comprises a plurality of handles 58, again preferably moulded integrally with the divider 114. These handles 58 enable each of the dividers 114 to be raised and lowered into position within the casing 112, whether manually or by lifting means such as a hoist or the like.

Figure 7:
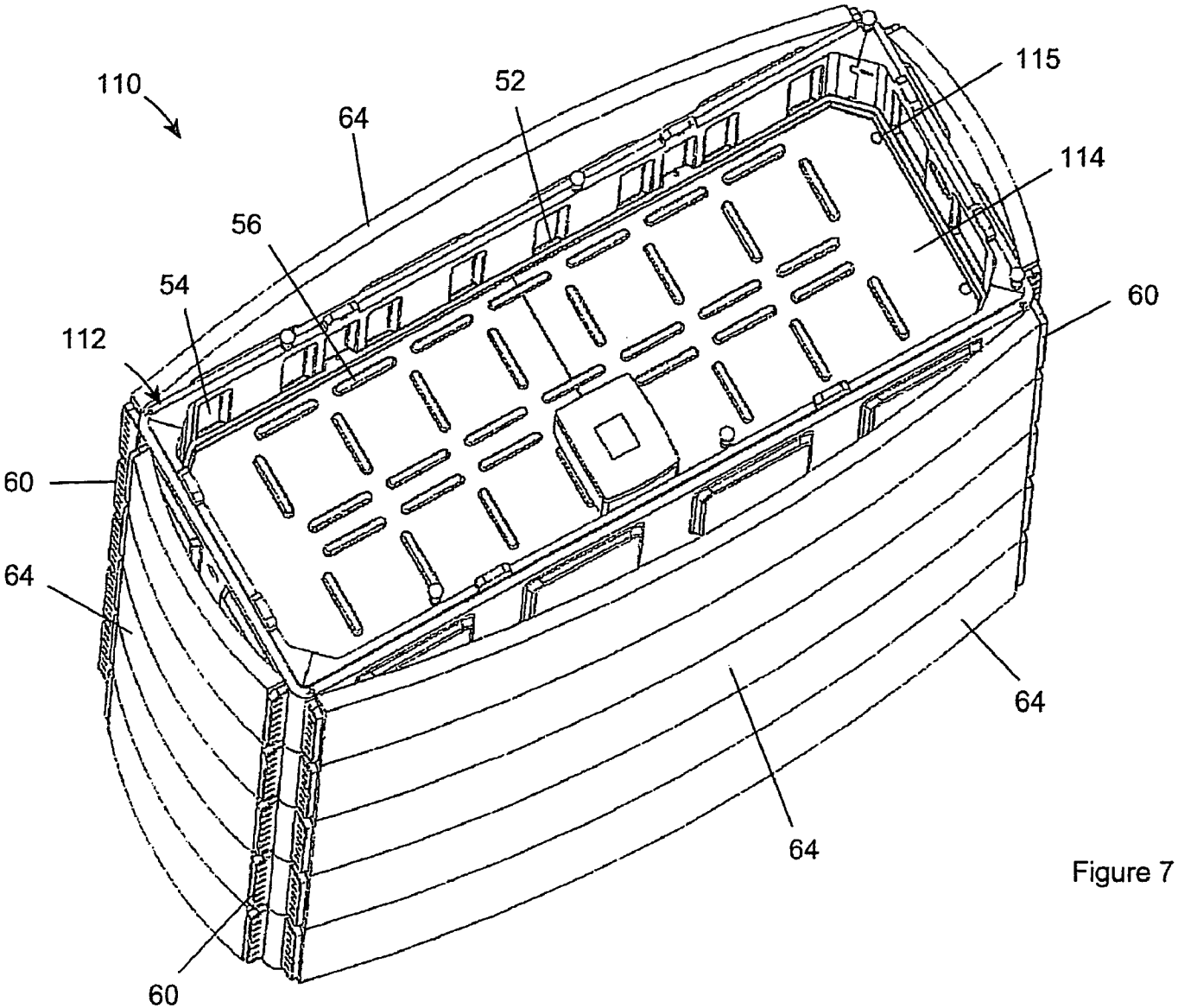
FIG. 7 shows a perspective view, from above, of the system illustrated in FIG. 4, with an optional outer wall fitted thereto.

As with the system of the first embodiment, the system 110 is adapted to enable a plurality of the casings 112 to be stacked side by side, in order to provide a large capacity in a relatively small space, for example for use as a mass grave or the like. The system 110 is therefore adapted, as described hereinafter, to be physically coupled to adjacent systems 110 in order to be combined into a unified array, and to prevent unwanted movement between adjacent systems 110. Each module 40 is therefore provided with connecting means in the form of a plurality of lugs 60, preferably located at each corner of the module 40, and projecting outwardly from same. Each lug 60 includes a number of apertures 62 therein. The lugs 60 therefore enable adjacent systems 110 to be secured together using mechanical fixing means such as cabling, nuts and bolts, or similar fasteners (not shown).

Where additional strength is to be provided to the casing 112, the system 110 may optionally comprise an outer wall defined by a plurality of wall portions 64. In the embodiment illustrated, each wall portion 64 is secured to the casing 112 via a pair of the lugs 60. Thus, each module 40 is provided with four wall portions 64 surrounding the module 40. The system 10 is therefore provided with a double wall in order to significantly improve the strength of the casing 112, allowing it to withstand greater pressure. Each wall portion 64 is preferably convex or bowed in form, as illustrated in FIG. 7. This shape significantly increases the strength of the outer wall, in particular resisting inward deformation as a result of pressure applied from the surround earth. As with the modules 40, each wall portion 64 is preferably moulded from a polymer, and may be hollow and capable of receiving ballast. Although in the embodiment illustrated, the wall portions 64 are secured via the lugs 60, it will be appreciated that any other suitable means of fixing the wall portions 64 in position may be employed. In addition, although not illustrated, each wall portion 64 may be provided with ribbing, in particular horizontal ribbing (not shown) in order to improve the strength and rigidity thereof. The lugs 60 also allow adjacent systems 110 to be stepped vertically with respect to one another, for example to suit a graveyard which is located on sloping ground.

Figure 4:
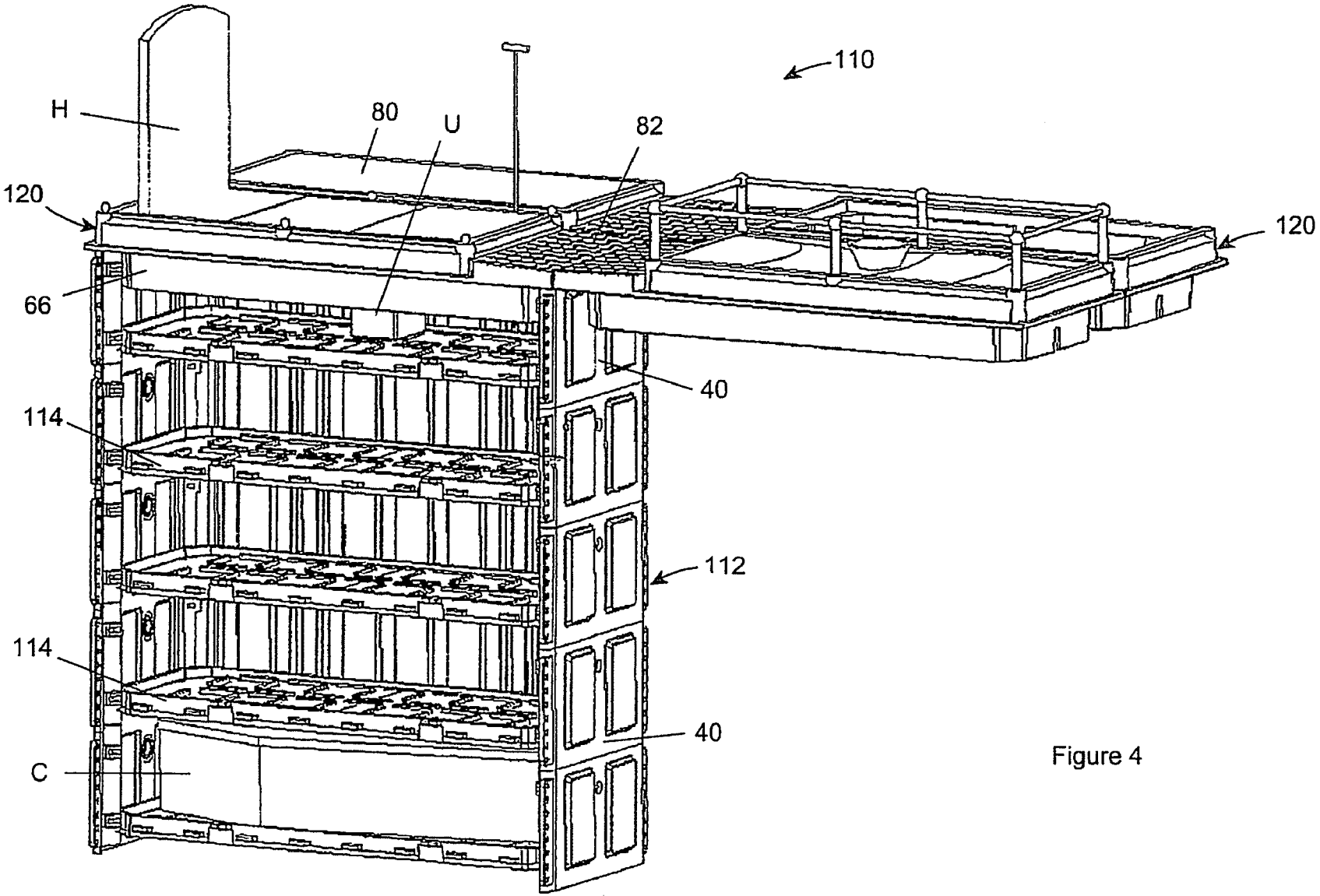
FIG. 4 shows a perspective view of a grave lining system according to a second embodiment of the invention, the system having a portion of a sidewall removed in order to reveal the interior of the system.
Figure 5:
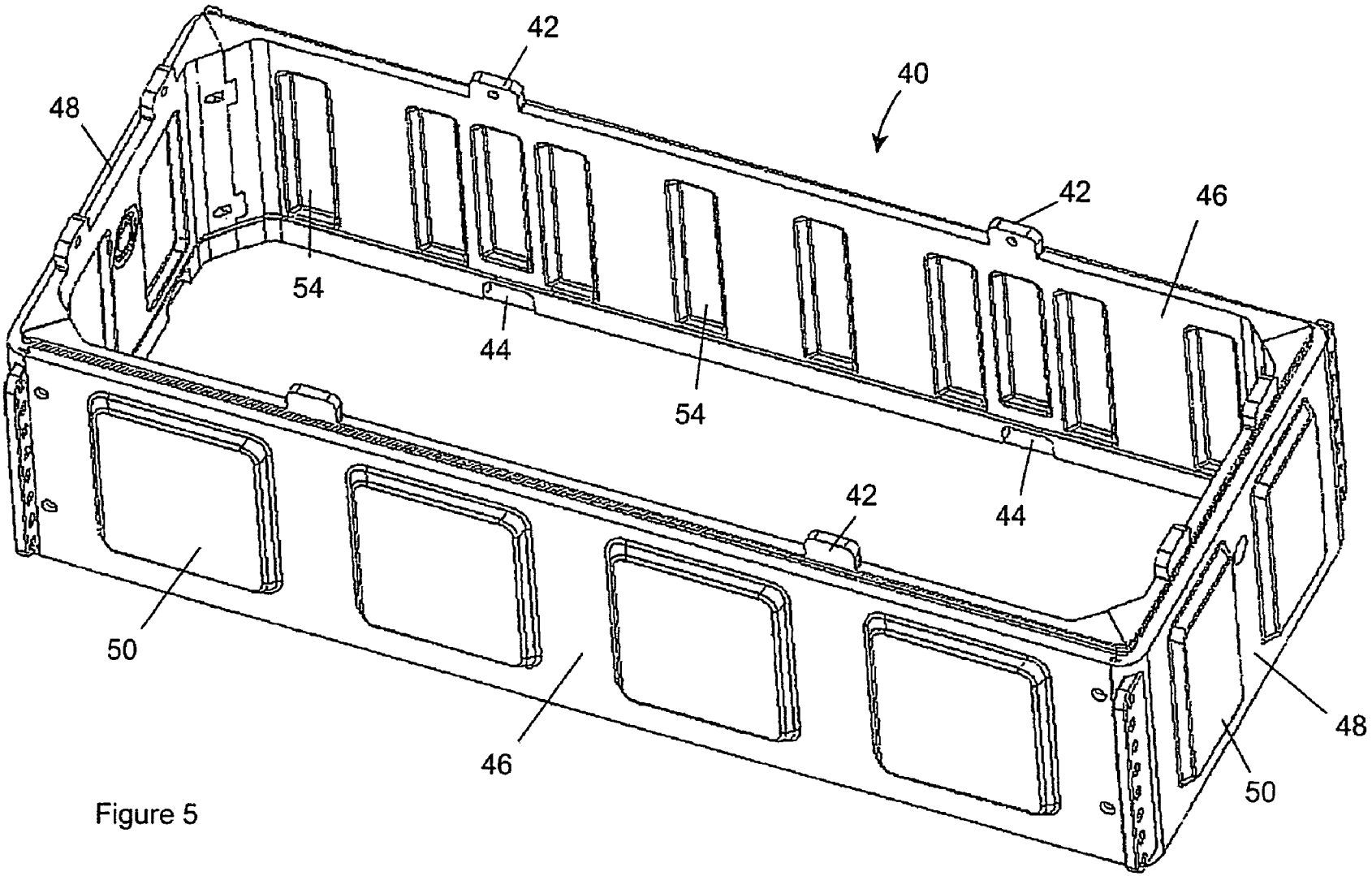
FIG. 5 illustrates a perspective view of a module, a stacked plurality of which form the system illustrated in FIG. 4.
Figure 8:
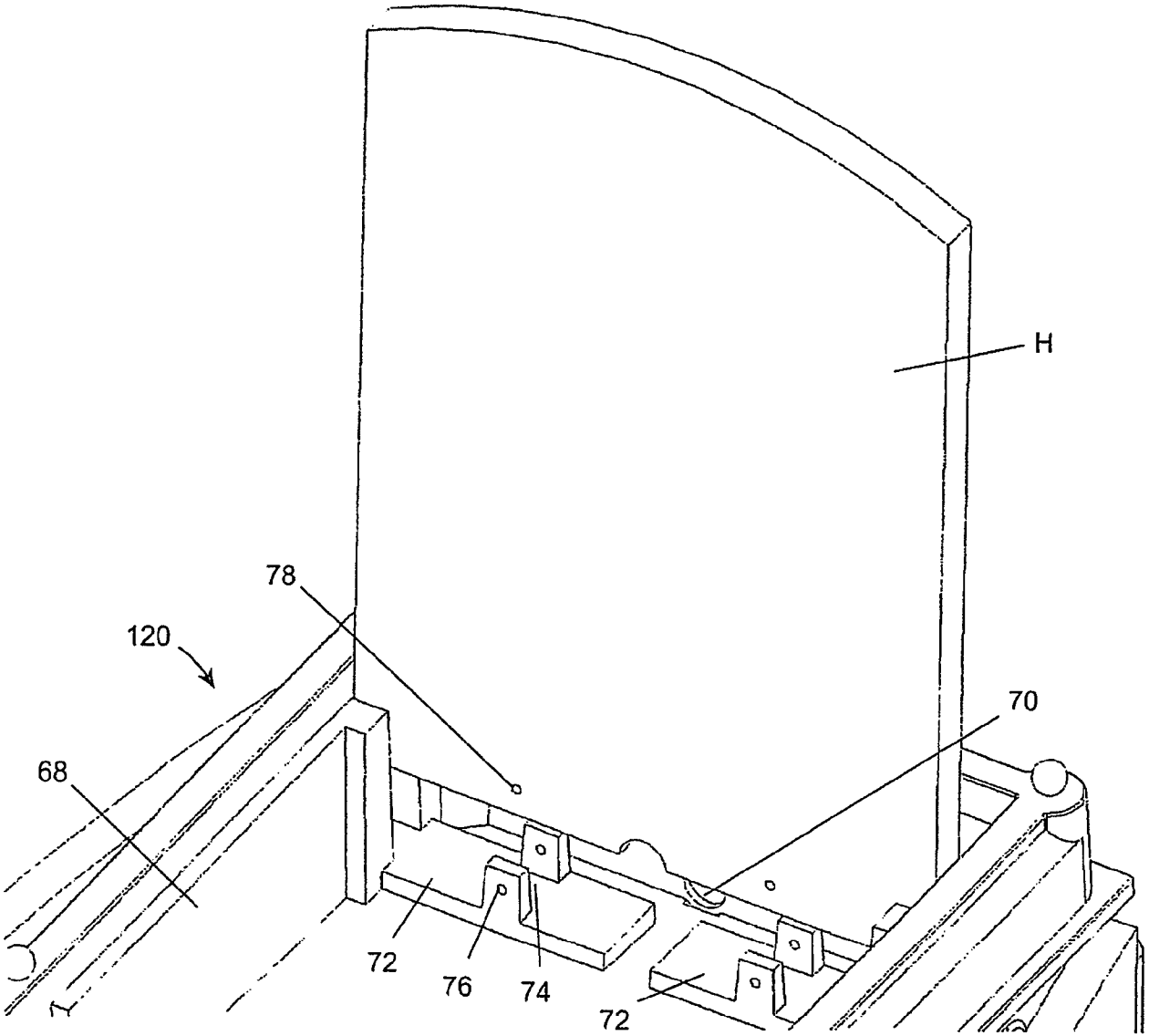
FIG. 8 illustrates a perspective view of a portion of a lid forming part of the system illustrated in FIGS. 4 to 7, and showing a headstone being lowered into position on the lid.

Referring now in particular to FIGS. 4 and 8, the system 110 further comprises a lid 120 which, in use, is located, and preferably positively secured, about an opening defined by the upper end of the casing 112, in order to, in use, close the upper opening. The lid 120 comprises a collar 66 projecting from an underside of the lid 120, which in use is seated in sleeve like fashion into the upper opening of the casing 112, in order to secure the lid 120 in position. Suitable locking means (not shown) may be provided to prevent the unauthorised removal of the lid 120 from the casing 112. The upper or outwardly accessible portion of the lid 120 comprises a tray 68 which, in use, may be filled with stones or soil, and flowers planted therein, in order to give the appearance of a conventional flower bed found at a grave. In order to prevent, in use, the tray 68 becoming water logged, a drainage hole 70 is provided at one end, and possibly at more than this one location, in order to allow the escape of excess water from within the tray 68. If only the single drainage hole 70 is provided, the tray 68 may be manufactured with a very slight slope towards the drainage hole 70 in order to ensure that the water is guided towards to drainage hole 70, in order to escape from the tray 68. The lid 120 may also be adapted to receive one or more irrigation tubes or the like (not shown) in operative association therewith, in order to enable the automatic watering of any flowers planted in the tray 68. Alternatively the lid may have irrigation tubing (not shown) formed integrally therein, the lid 120 then being provided with a conventional hose type connection at a suitable position on the lid 120, in order to supple water to the irrigation tubing (not shown).

The lid 120 also comprises securing means in the form of a pair of brackets 72 which together define a slot 74 for receiving a headstone H as illustrated in FIG. 8. Apertures 76 may be provided in each of the brackets 72, and corresponding apertures 78 provided in the headstone H in order to allow the headstone H to be secured to the lid 20, for example by passing a pin through the brackets 72 and headstone H.

In use, the headstone H would initially be positioned and locked to the lid 120, and the tray 68 then filled with soil, to be planted with suitable flowers or the like. In this way, the brackets 72 and the physical fixing of the headstone H to the lid 120 will be covered, thus providing a clean overall appearance to the finished system 110. The headstone H can however be quickly and easily removed from the lid 120, for example if in need of repair, or if additional names or inscriptions are to be provided thereon. Similarly, a replacement headstone could be fitted to the lid 120. It will be appreciated that the lid 120 could be used, without the casing 112, above a conventional grave.

Referring back to FIG. 4, it can be seen that although a single casing 112 is illustrated, four of the lids 120 are shown, arranged in a rectangular array. In use, each of the lids 120 would be associated with a respective casing 112, which have however been omitted simply for the purposes of clarity. It can be seen that, in the three lids 120 under which no casing 112 is shown, a number of inserts 80 are positioned within the respective tray 68, in order to fill same. These inserts 80 may be used where the system 10 is not yet in use, or indeed, if a flower bed is not to be located within the tray 68.

The lid 120 also comprises a pedestrian platform 82 formed integrally with the lid 120, at one end thereof. Thus in use, where a single system 110 is provided, the platform 82 provides a location at which a visitor to a grave may stand. Furthermore, when a plurality of the systems 110 are located in a rectangular array as illustrated in FIG. 4, the platforms 82 combine to define a walkway between adjacent graves.

The lid 120 may be provided with lifting eyes (not shown) or the like, in order to allow the lid 120 to be removed from the respective casing 112, for example by means of a hoist or the like. The lid 120 may also be provided with connection points (not shown) such as sockets, to receive decorative finials (not shown) or the like about the lid 120.

It will thus be appreciated that the system 10, 110 of the present invention provides a relatively simple yet effective means of providing a large capacity grave while maintaining substantially the same footprint as a conventional grave.

The invention claimed is:

1. A grave lining system comprising a sidewall defining an enclosure; at least one divider; and retaining means in operative association with the sidewall for supporting the at least one divider in a position dividing the enclosure into substantially separate compartments; a lid engageable about an opening defined by the sidewall in order to substantially seal the opening, the lid comprising a fillable tray having a recessed bottom surface and means for securing a headstone to the lid, characterized in that the securing means is positioned at the recessed bottom surface in the tray such that when the tray is filled the securing means is covered; the securing means including at least one bracket receiving the headstone and secured thereto via at least one fastener.

2. A grave lining system according to claim 1 in which the enclosure comprises a plurality of stackable modules which in combination define the sidewall.

3. A grave lining system according to claim 2 in which a divider is provided for each module.

4. A grave lining system according to claim 1 in which the sidewall comprises a plurality of protrusions formed therein.

5. A grave lining system according to claim 1 in which the retaining means comprises sets of tongues and grooves, the tongues being provided on the at least one divider and the grooves being provided on the sidewall.

6. A grave lining system according to claim 1 comprising connecting means provided about the sidewall externally of the enclosure.

7. A grave lining system according to claim 6 in which the connecting means are adapted to enable two or more of the grave lining systems to be connected to one another.

8. A grave lining system according to claim 1 comprising an outer wall locatable about at least a portion of the sidewall.

9. A grave lining system according to claim 8 in which at least a portion of the outer wall is hollow and capable of receiving ballast therein.

10. A grave lining system according to claim 1 comprising connecting means provided about the sidewall externally of the enclosure, an outer wall locatable about at least a portion of the sidewall, and wherein the outer wall is connectable to the connecting means.

11. A grave lining system according to claim 1 in which at least a portion of the sidewall is hollow and capable of receiving ballast therein.

12. A grave lining system according to claim 1 in which the at least one divider comprises a drain.

13. A grave lining system according to claim 1 in which the lid comprises a pedestrian platform.

14. The grave lining system of claim 1, further comprising at least one connecting lug provided on said sidewall externally of the enclosure.

15. The grave lining system of claim 14, wherein said lug is adapted to enable two or more of the grave lining systems to be connected to one another.

* * * * *